US005797691A

United States Patent [19]

Suzuki

[11] Patent Number: 5,797,691

[45] Date of Patent: Aug. 25, 1998

[54] CARRIAGE DRIVER HAVING A DISTORTION PROHIBITING MECHANISM

[75] Inventor: Kanji Suzuki, Shizuoka, Japan

[73] Assignee: Star Micronics, Co., Ltd., Shizuoka, Japan

[21] Appl. No.: 881,099

[22] Filed: Jun. 24, 1997

[30] Foreign Application Priority Data

Jun. 25, 1996 [JP] Japan ..... 8-184064

[51] Int. Cl.[6] ..... B41J 19/20

[52] U.S. Cl. ..... 400/320; 400/328; 347/37

[58] Field of Search ..... 400/319, 320, 400/322, 328; 74/89.15, 424.8 R; 409/238; 347/37

[56] References Cited

U.S. PATENT DOCUMENTS 4,544,293 10/1985 Cranston et al. ..... 400/328
4,856,919 8/1989 Takeuchi et al. ..... 400/328
5,349,731 9/1994 Sheehan ..... 74/89.15
5,402,156 3/1995 Donahue et al. ..... 347/37

FOREIGN PATENT DOCUMENTS 5-31992 2/1993 Japan .

*Primary Examiner*—John S. Hilten
*Attorney, Agent, or Firm*—Whitham, Curtis & Whitham

[57] ABSTRACT

A carriage driver includes a cam shaft having a shaft, a cylinder provided around the shaft and made of material of which thermal expansion coefficient is different from that of the shaft, and a cam groove provided on the cylinder, a carriage motor which rotatively drives the cam shaft, a carriage having a print head and movably mounted on the cam shaft, and a prohibiting mechanism provided at boundaries between the shaft and the cylinder of the cam shaft and simultaneously at ends of printing area, in order to prohibit distortion of the cam shaft in an axial direction due to change in temperature.

9 Claims, 10 Drawing Sheets

CARRIAGE DRIVER HAVING A DISTORTION PROHIBITING MECHANISM

BACKGROUND OF THE INVENTION

1. Field of the Invention

The present invention relates to a carriage driver for a serial printer, etc., which drives a carriage on which a print head is mounted, and, more particularly, to a carriage driver having a cam shaft with an endless cam groove, and through improvement of arrangement of such a cam groove, the carriage driver minimizes the amount of distortion of the cam shaft in an axial direction thereof due to change in temperature, and consequently prevents the deterioration in printing quality.

2. Description of the Related Art

FIG. 7 illustrates a typical structure of a carriage driver for a serial printer, etc., as an example of the prior art. Note that there are many parts necessary to be described in the prior art, but some of them will not be shown in the drawings, nor given any reference numeral. There is a cam shaft 101, as shown in FIG. 7, which rotates in a constant direction by a carriage motor via a rotation transmission mechanism. There is a guide shaft which is placed parallel to the cam shaft 101. A carriage is mounted striding both over the cam shaft 101 and over the guide shaft, so that, when the cam shaft 101 rotates in a constant direction, the carriage can make reciprocating movement (in the directions of both ends of the cam shaft 101) along the cam shaft 101 as well as the guide shaft. The carriage is provided with a cam follower which engages with a cam groove 103 of the cam shaft 101, and the rotation of the cam shaft 101 in a constant direction causes reciprocating movement of the carriage in the direction of an axis of the cam shaft 101.

There is a print head provided on the carriage, and through reciprocating movement of the carriage, the predetermined printing is carried out on printing paper by the print head.

As illustrated in FIG. 7, the cam shaft 101 has a shaft 105 made of metal, and a cylinder 107 (made of engineering plastic) is integrally formed around the shaft 105 by means of insert injection molding. The cam groove 103 runs on the surface of the cylinder 107 in an endless screw line.

As above described, there are two materials used for the cam shaft 101, namely, the metal for the shaft 105 and the engineering plastic for the cylinder 107, which are integrally formed by insert injection molding. However, compared with the metal for the shaft 105, the engineering plastic for the cylinder 107 tends to expand or contract (the thermal distortion) due to change in temperature.

The amount of change in dimension of the cylinder 107 due to thermal expansion (Δa) is determined by the following formula (I):

$$\Delta a = K \cdot L \cdot \Delta T \cdot 10^{-5} \text{ (cm)} \ldots \quad \text{(I)}$$

in which:

- Δa represents the amount of change in dimension of the cylinder 107;
- K represents the linear expansion coefficient of the cylinder 107;
- L represents the length of the cylinder 107; and
- ΔT represents the change in temperature (° C.).

The amount of change in dimension of the cylinder 107 Δa), which is obtained by the above formula (I), shall be larger than the amount of change in dimension of the shaft 105 made of metal.

The thermal distortion due to change in temperature occurs, firstly when the injection molding is completed, and secondly when there is any environmental change during operation of the printer.

During injection molding, the cylinder 107 is rather in has a relatively a high temperature. After the completion of injection molding, the cylinder 107 resumes a normal temperature. Thus the cylinder 107 shrinks both in the axial direction and the radial direction.

When there is any environmental change during operation of the printer, namely, each time when the temperature around the cylinder 107 rises or falls due to any environmental factor, the cylinder 107 expands both in the axial direction and the radial direction, or shrinks in these directions.

It is true that the shaft 105 made of metal also expands or shrinks. However, as above described, the amount of distortion of the shaft 105 is smaller than that of the cylinder 107.

Consequently, in the prior art, there is provided a ring-shaped groove 109 formed at the center of the axis of the shaft 105. A part of the resin used for the cylinder 107 (engineering plastic) serves as a ring-shaped protrusion 111, which is engaged with the ring-shaped groove 109. When the cylinder 107 resumes a normal temperature after the completion of injection molding, the engaging portion which consists of the ring-shaped groove 109 and the ring-shaped protrusion 111 serves as the reference portion of shrinkage of the cylinder 107 so that the stable positioning between the shaft 105 and the cylinder 107 may be obtained.

However, the prior art has the following disadvantages:

The stable positioning between the shaft 105 and the cylinder 107, against the thermal shrinkage after the completion of injection molding, is in fact obtained by an engaging portion which consists of the ring-shaped protrusion 111 and the ring-shaped groove 109. But there is no countermeasure taken against the subsequent thermal distortion of the cylinder 107 due to environmental change during operation of the printer. Consequently, the cylinder 107 may seriously cause the thermal distortion, namely the thermal expansion or shrinkage in a large amount in the axial direction, which results in the deviation of position of the cam groove 103.

FIG. 8 illustrates an example of the thermal expansion, and FIG. 9 illustrates an example of the thermal shrinkage, as shown by dashed lines respectively.

When the position of the cam groove 103 deviates due to thermal distortion as above described, such a deviation further causes the deviation of the position of the carriage, the deviation of the position of the print head, and finally, the deviation of printing dots. Consequently, the quality of printing deteriorates. The state of such a deviation of dots is illustrated in FIG. 10, in which the dots in correct positions are as shown in the upper portion in FIG. 10, and the dots in deviated positions are as shown below the correct ones in FIG. 10. It may be noted that there are deviations of dots by ΔL from the correct positions in the axial direction. Since the thermal expansion or shrinkage in the radial direction will not affect the printing quality, there is no need for considering the thermal distortion in the radial direction.

SUMMARY OF THE INVENTION

It is an object of the present invention to provide a carriage driver, which minimizes the amount of distortion of the cam shaft in an axial direction thereof due to change in temperature, and consequently which prevents the deterioration in printing quality.

To achieve the object mentioned above, according to the present invention, there is provided a carriage driver comprising a cam shaft having a shaft, a cylinder provided around the shaft and made of material having a thermal expansion coefficient different from that of the shaft, and a cam groove provided on the cylinder, a carriage motor which rotatively drives the cam shaft, a carriage having a print head and movably mounted on the cam shaft, and a plurality of prohibiting means provided at boundaries between the shaft and the cylinder of the cam shaft and simultaneously at both ends of printing area, in order to prohibit distortion of the cam shaft in an axial direction due to change in temperature.

The carriage driver is provided with a plurality of prohibiting means provided at boundaries between the shaft and the cylinder of the cam shaft and simultaneously at both ends of printing area, in order to prohibit distortion of the cam shaft in an axial direction due to change in temperature, the carriage driver prevents the deviation of position of the carriage, the deviation of position of the print head, and finally, the deterioration in printing quality.

Preferably, the thermal expansion coefficient of the shaft may be smaller than the thermal expansion coefficient of the cylinder, and the prohibiting means restricts thermal distortion of the cylinder in the axial direction within an amount of thermal distortion of the shaft in the axial direction.

Preferably, the prohibiting means may be engagements of intrusion with a protrusion provided at boundaries between the shaft and the cylinder.

Preferably, the prohibiting means may be ring-shaped grooves formed either on the shaft or on the cylinder, and ring-shaped protrusions formed either on the cylinder or on the shaft to be engaged with the ring-shaped grooves.

Preferably, the prohibiting means may be penetrating holes formed through the shaft in a radial direction, and stems formed in the cylinder to be engaged with the penetrating holes.

Preferably, the shaft may be made of metal, and the cylinder may be made of engineering plastic, and the shaft and the cylinder may be integrally formed by insert injection molding, and during the insert injection molding, the ring-shaped grooves may be formed on the shaft, and the ring-shaped protrusions may be formed by intruding the engineering plastic into the ring-shaped grooves provided on the shaft.

Preferably, the shaft may be made of metal, and the cylinder may be made of engineering plastic, and the shaft and the cylinder may be integrally formed by insert injection molding, and during the insert injection molding, the penetrating holes may be formed through the shaft in a radial direction, and the stems may be formed by intruding the engineering plastic into the penetrating holes.

Preferably, further prohibiting means similar to the prohibiting means provided at both ends of printing area, may be provided at one or more positions between both ends of printing area at which the prohibiting means are provided.

Preferably, the prohibiting means similar to the prohibiting means provided at both ends of printing area, may be equidistantly positioned from the prohibiting means provided at both ends of the printing area.

With this structure, since the carriage driver is provided with a plurality of prohibiting means provided at boundaries between the shaft and the cylinder of the cam shaft and simultaneously at both ends of printing area, the carriage driver prevents distortion of the cam shaft in an axial direction due to change in temperature, the carriage driver prevents the deviation of position of the carriage, the deviation of position of the print head, and consequently, the deterioration in printing quality.

When the further prohibiting means similar to the prohibiting means provided at both ends of printing area is provided at one or more positions between both ends of the printing area at which the prohibiting means are provided, the amount of thermal distortion due to change in temperature is further minimized.

BRIEF DESCRIPTION OF THE DRAWINGS

The invention will be described below in detail with reference to the accompanying drawings, in which.

DETAILED DESCRIPTION OF THE PREFERRED EMBODIMENTS

First Embodiment

Figure 1:
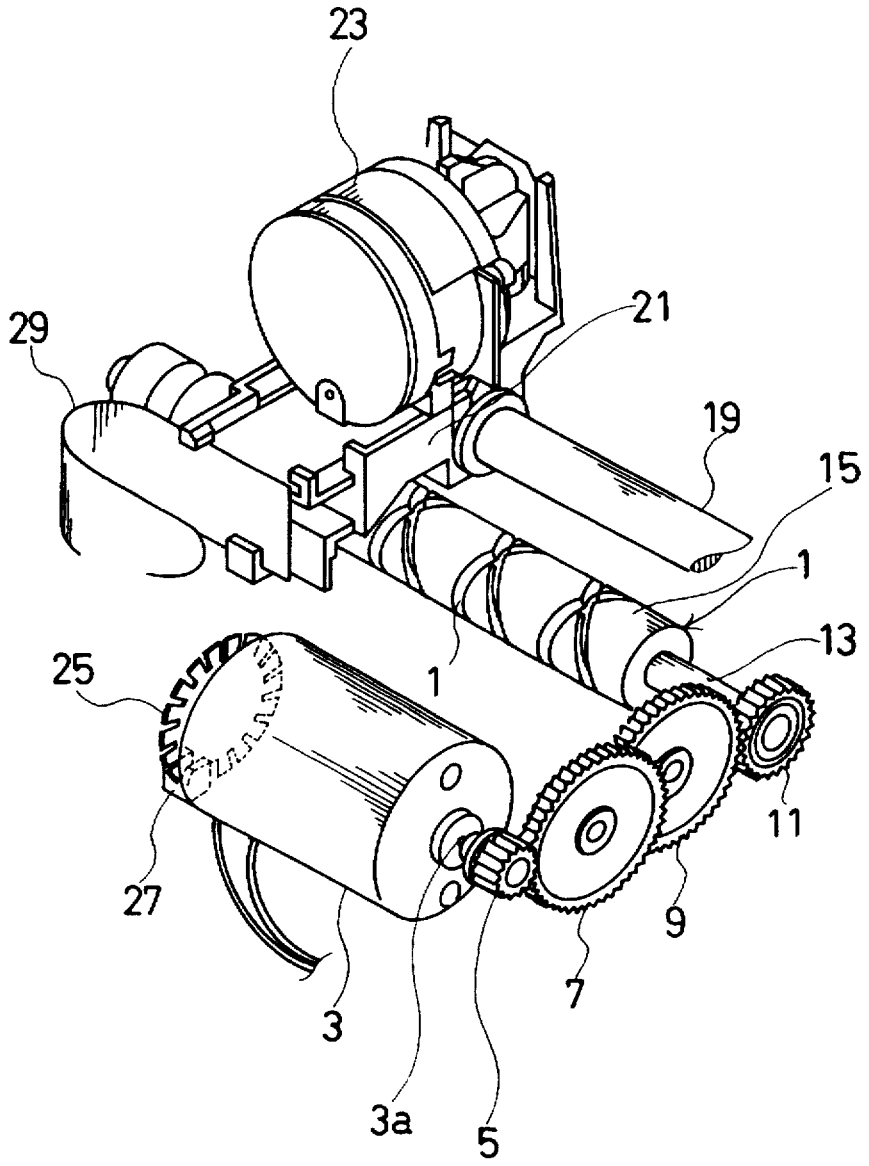
FIG. 1 is a perspective view of a part of a carriage driver for a serial printer according to a first embodiment of the present invention.

A first embodiment of the present invention will now be described in detail with reference to FIGS. 1 through 4. FIG. 1 is a perspective view showing a structure of a carriage driver. There is a cam shaft 1. There is also a carriage motor 3, and a gear 5 is fixed on an output shaft 3*a* of the carriage motor 3. The gear 5 is engaged with a gear 7, and another unillustrated gear is coaxially fixed on the gear 7. The unillustrated gear is engaged with a gear 9, and the gear 9 is engaged with a gear 11. The gear 11 is fixed on a shaft 13 of the cam shaft 1. Consequently, when the carriage motor 3 drives in a constant direction, the cam shaft 11 rotates in any constant direction.

Figure 2:
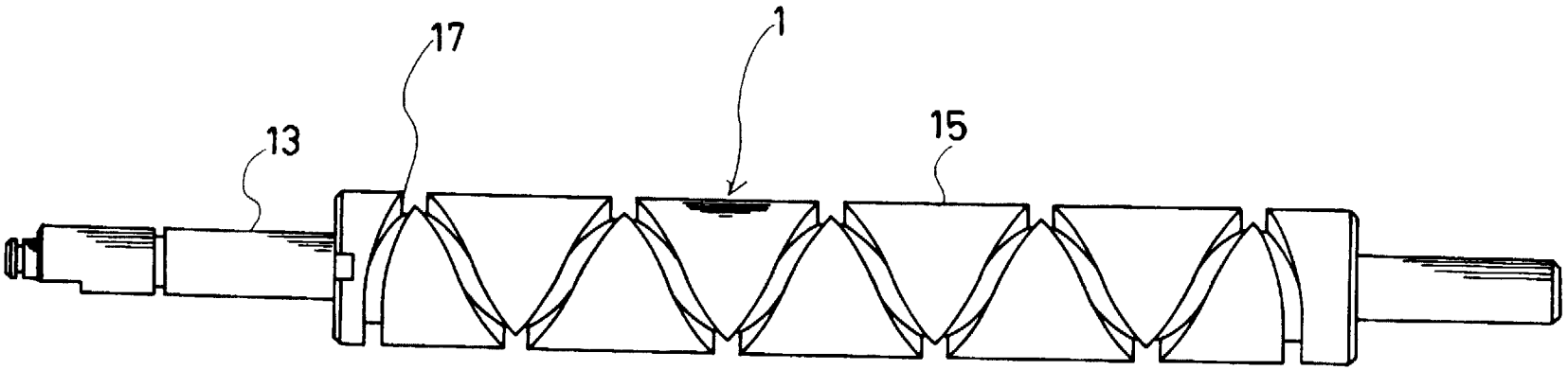
FIG. 2 is an elevational view of a cam shaft according to the first embodiment of the present invention.

As illustrated in FIG. 2, the cam shaft 1 consists of the shaft 13 and a cylinder 15 around the shaft 13, and is integrally formed by insert injection molding. The shaft 13 is made of metal, while the cylinder 15 is made of engineering plastic. The cylinder 15 has a cam groove 17 running in an endless screw line on the surface thereof.

Now referring back to FIG. 1, there is a guide shaft 19 positioned parallel to the cam shaft 1, and a carriage 21 is mounted striding both over the cam shaft 1 and over the guide shaft 19. The carriage 21 is provided with a cam follower (not shown) which is in movable engagement with the cam groove 17 of the cam shaft 1. When the cam shaft 1 rotates in a constant direction, the carriage 21 makes reciprocating movement (in the directions of both ends of the cam shaft 1) along the cam shaft 1 as well as the guide shaft 19, via the cam groove 17 and the cam follower.

There is a print head 23 provided on the carriage 21. When the carriage 21 makes reciprocating movement, the print head 23 integrally moves in the same direction, and hence, the predetermined printing is carried out on printing paper (not shown).

FIG. 1 also illustrates a timing disk 25 and a timing detector 27 in the rear of the carriage motor 3. Reference numeral 29 is a flexible cable.

Figure 3:
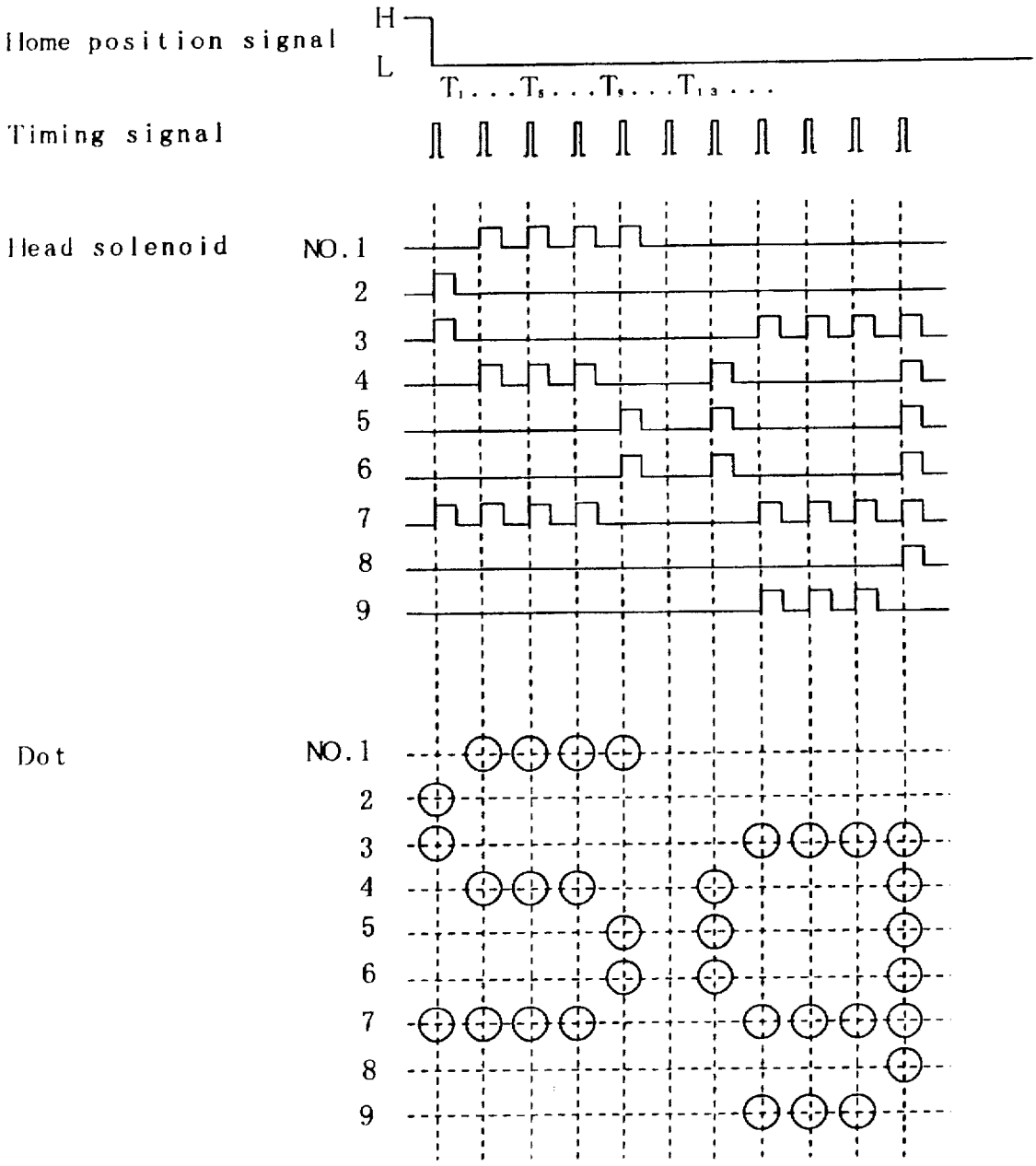
FIG. 3 is a chart showing an example of print timing according to the first embodiment of the present invention.

An example of print timing of the serial printer comprising a carriage driver according to the first embodiment of the present invention, is shown in the chart in FIG. 3. Items indicated in the left of the chart are, in the order from the top, a home position signal, timing signals ($T_1$, $T_2$, . . . ), signals showing the timing of excitation and non-excitation of solenoids of the print head 23 (head solenoid No. 1 through 9), and actuation and non-actuation of dots (dot No. 1 through 9).

Figure 4:
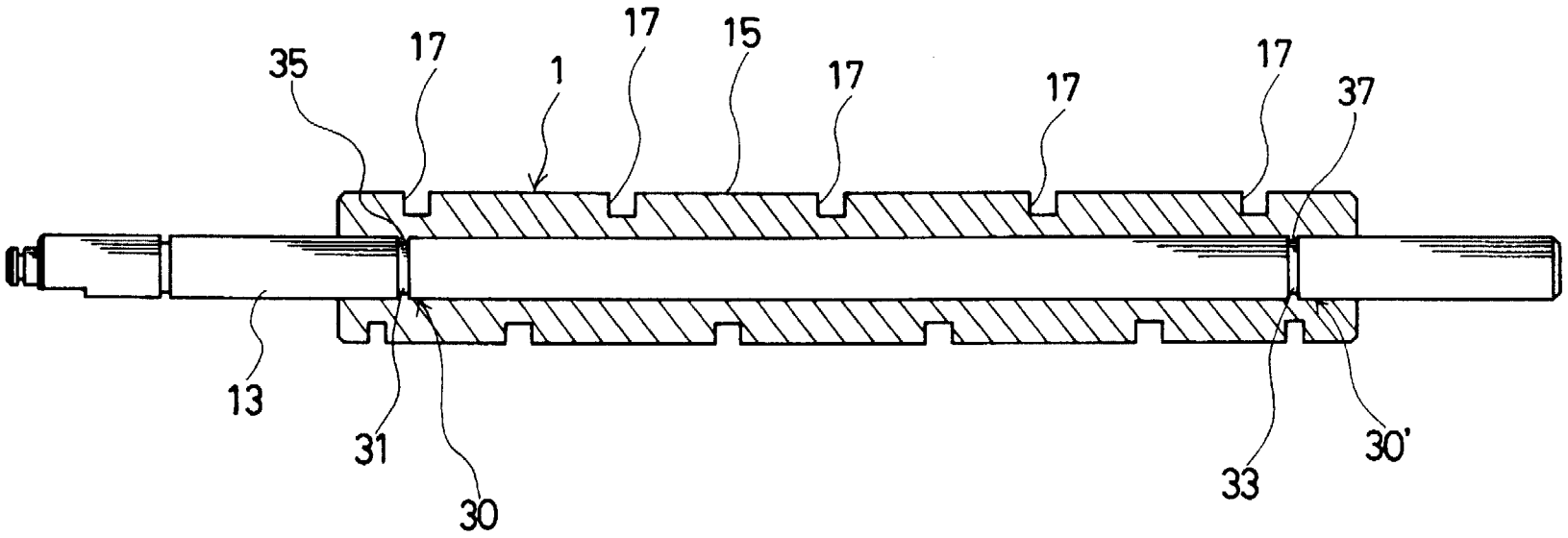
FIG. 4 is an elevational sectional view of a cam shaft according to the first embodiment of the present invention.

As illustrated in FIG. 4, according to the first embodiment of the present invention, the shaft 13 of the cam shaft 1 is provided, at the respective ends of the printing area as long as the shaft 13 concerns, with a pair of prohibiting means 30 and 30' in order to prohibit distortion of the shaft 13 in the axial direction due to change in temperature. The prohibiting means 30 and 30' are respectively provided with a pair of ring-shaped grooves 31 and 33. During injection molding of the cam shaft 1, the engineering plastic as the material for the cylinder 15 goes into these ring-shaped grooves 31 and 33, so that such parts corresponding to the ring-shaped grooves 31 and 33 serve as a pair of ring-shaped protrusions 35 and 37. In the thus mentioned structure, the pair of ring-shaped grooves 31 and 33 are respectively engaged with the pair of ring-shaped protrusions 35 and 37, and each engagement serves the prohibiting means 30 and 30' respectively. Consequently, the pair of prohibiting means 30 and 30' prohibits the thermal distortion between these prohibiting means 30 and 30' due to change in temperature, for the purpose of preventing the deterioration of printing quality.

The function and effect of the present invention based on the above structure will now be described.

As above described, the pair of prohibiting means 30 and 30', which consist of the ring-shaped groove 31 and the ring-shaped protrusion 35, and of the ring-shaped groove 33 and the ring-shaped protrusion 37, respectively prohibit the thermal distortion between these prohibiting means 30 and 30' due to change in temperature. Since there are engagements of the ring-shaped groove 31 with the ring-shaped protrusion 35, and the ring-shaped groove 33 with the ring-shaped protrusion 37, when the linear expansions of the shaft 13 and the cylinder 15 are caused in the axial direction due to rise in temperature, the above engagements (i.e. the prohibiting means 30 and 30') prohibit the linear expansion of the cylinder 15 because the shaft 13, having a linear expansion coefficient smaller than that of the cylinder 15, prohibits the linear expansion of the cylinder 15. Consequently, the amount of the linear expansion of the cylinder 15 in the axial direction is minimized according to the linear expansion coefficient of the material of the shaft 13 (in the present case, metal), and such an amount shall be quite little.

On the other hand, since the expansion of the cylinder 15 in the axial direction is prohibited by the shaft 13, the cylinder 15 expands in the radial direction instead. However, as long as the expansion in the axial direction is prohibited, the deviation of position of the cam groove 17 is prohibited. Thus it is possible to prevent the deterioration in printing quality. The expansion in the radial direction will not affect the printing quality.

Although it is expected that the cylinder 15 may expand in a larger amount outside the prohibiting means 30 and 30' (namely, the sides close to each end of the cylinder 15), since the printing is not carried out in such portions, there is no possibility of deterioration in printing quality.

Second embodiment

Figure 5:
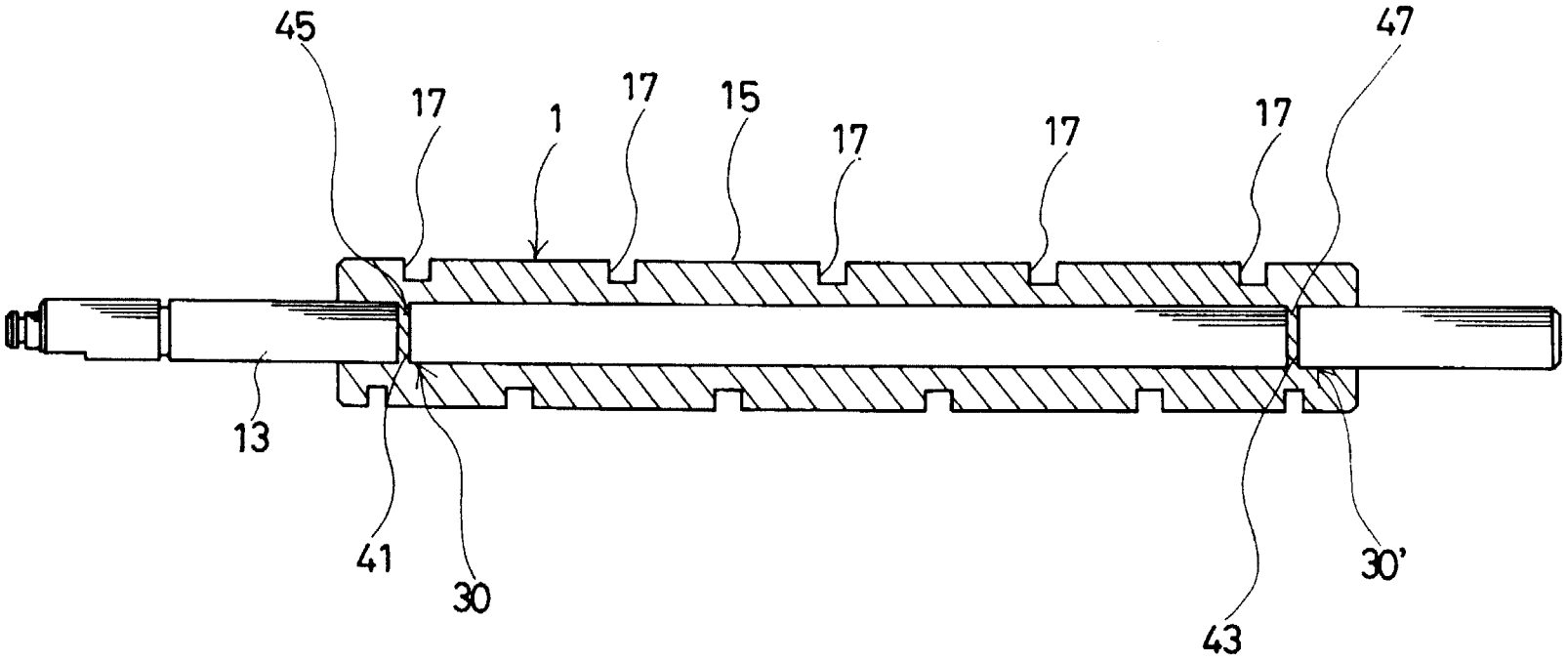
FIG. 5 is an elevational sectional view of a cam shaft according to a second embodiment of the present invention.

A second embodiment of the present invention will now be described with reference to FIG. 5. In the first embodiment, the shaft 13 is provided with the pair of ring-shaped grooves 31 and 33, which are respectively engaged with the pair of ring-shaped protrusions 35 and 37, and these engagements serve as the prohibiting means 30 and 30'. In the second embodiment, as shown in FIG. 5, the shaft 13 is provided with a pair of holes 41 and 43. With this structure, the engineering plastic used for the cylinder 15 goes into the pair of holes 41 and 43, so that a pair of stems 45 and 47, respectively corresponding to the holes 41 and 43, can be formed. The shaft 13 and the cylinder 15 are integrated by engagements of such prohibiting means, namely the engagements of the hole 41 with the stem 45 and the hole 43 with the stem 47. Hence, the same effect as that of the first embodiment can be obtained.

Third embodiment

Figure 6:
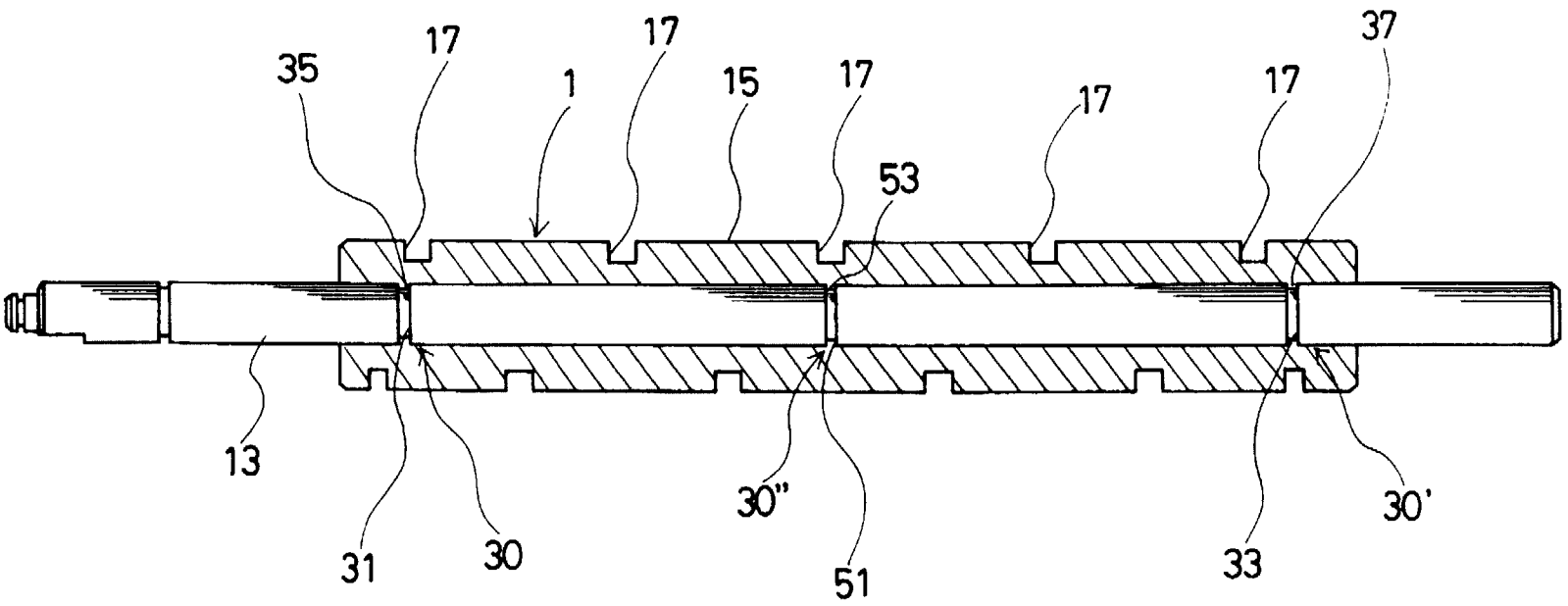
FIG. 6 is a an elevational sectional view of a cam shaft according to a third embodiment of the present invention.
Figure 7:
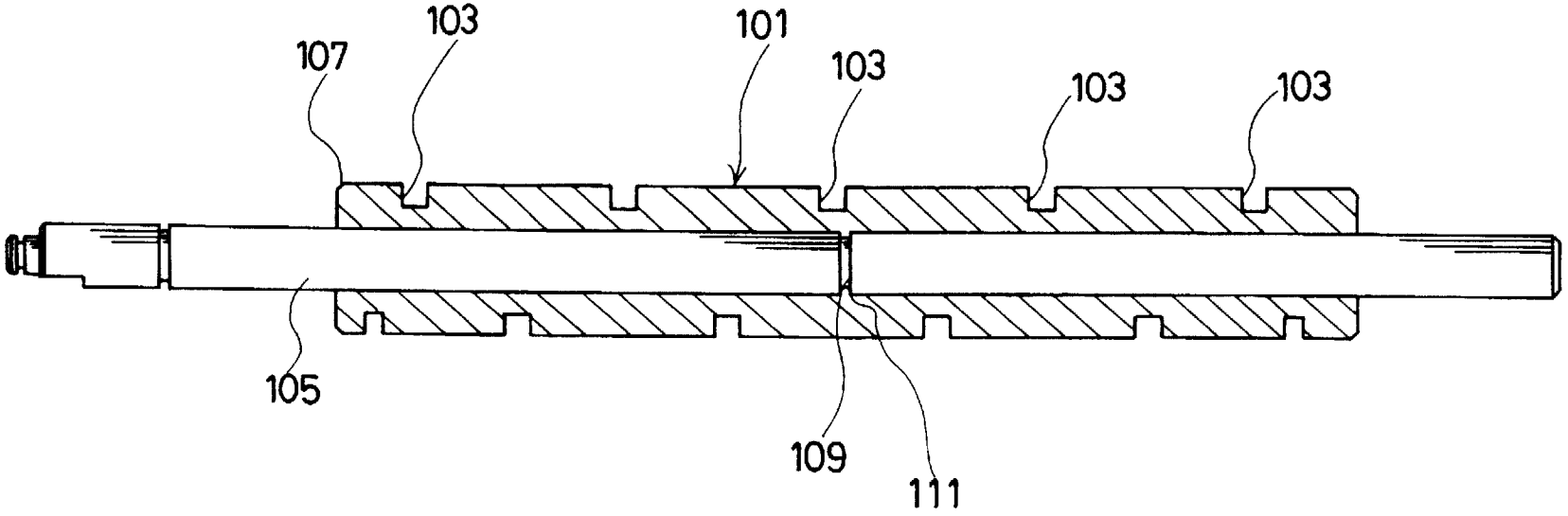
FIG. 7 (PRIOR ART)
FIG. 7 is an elevational sectional view showing a prior art cam shaft.
Figure 8:
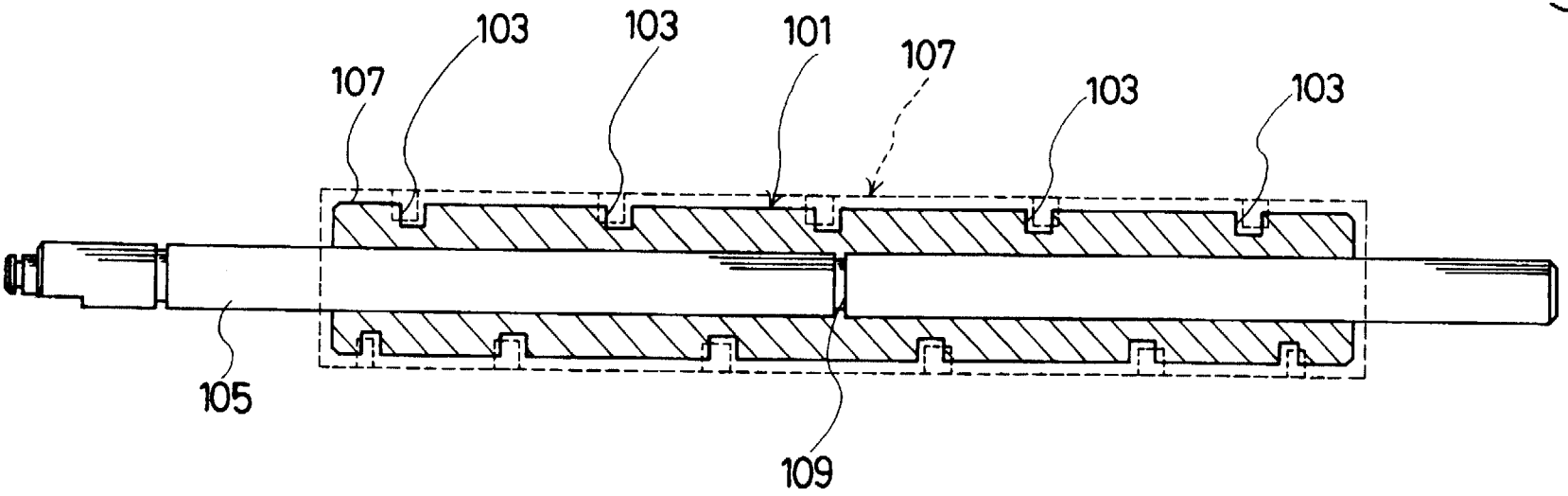
FIG.8 (PRIOR ART)
FIG. 8 is a sectional view showing the prior art of a cam shaft in a state of expansion.
Figure 9:
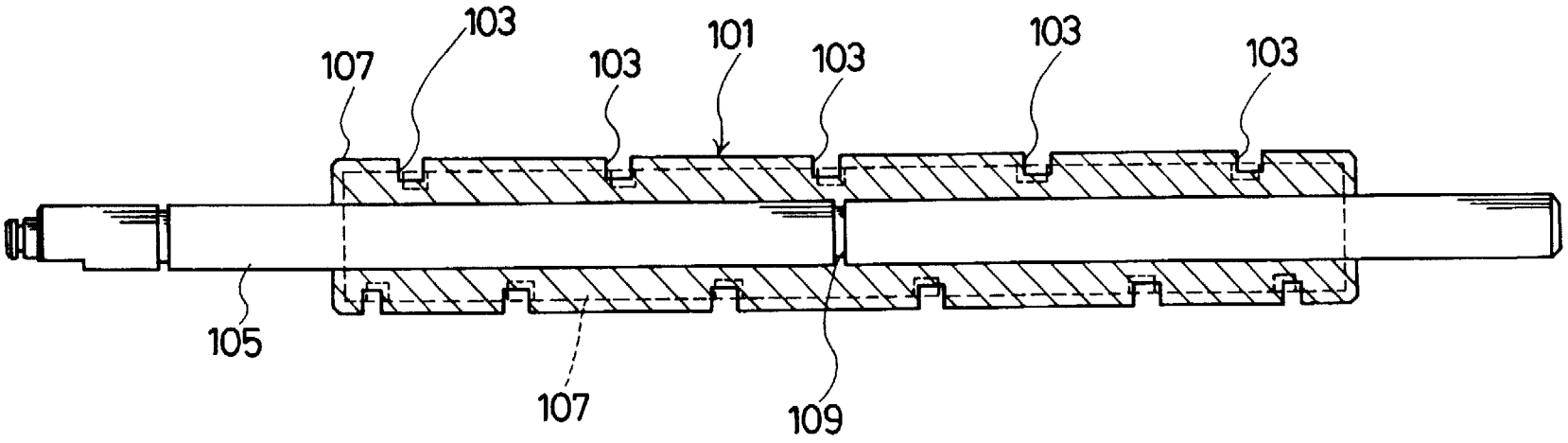
FIG.9 (PRIOR ART)
FIG. 9 is a sectional view showing the prior art of a cam shaft in a state of shrinkage.
Figure 10:
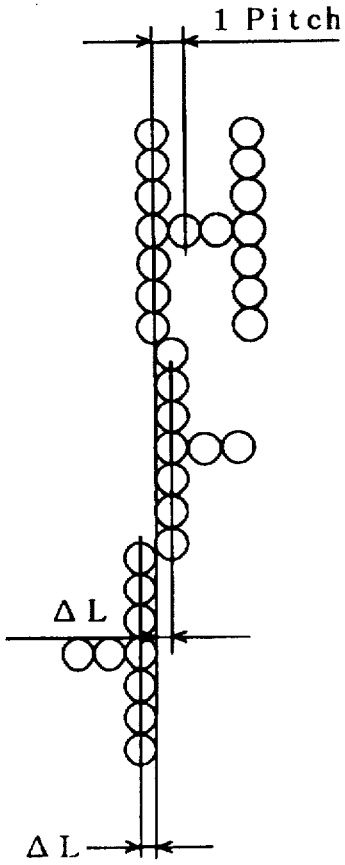
FIG.10 (PRIOR ART)
FIG. 10 is a schematic view showing states of deviation of dots.

A third embodiment of the present invention will now be described with reference to FIG. 6. There is a prohibiting means 30" at the center between the prohibiting means 30 and 30', which are discussed in the first embodiment. The prohibiting means 30" consists of a ring-shaped groove 51 provided on the shaft 13, and a ring-shaped protrusion 53 provided on the cylinder 15.

It is clear that the present invention is not limited to the embodiments as described above. For example, one or more prohibiting means like the prohibiting means 30" may be added to the cam shaft in the third embodiment.

In the first through third embodiments, the metal is used as the material of the shaft, and the engineering plastic is used as the material of the cylinder. However, the shaft and the cylinder are not limited to these materials, and any other type of materials can be used similarly, provided that cylinder is made of any material having a relatively high thermal expansion coefficient, and that the shaft is made of another material having a relatively smaller thermal expansion coefficient.

In addition, in the first through third embodiments, the grooves are provided on the shaft, and the protrusions are provided on the cylinder however, the provision of the grooves and protrusions may be, vice versa.

What is claimed is:

1. A carriage driver comprising:

a cam shaft including a shaft, a cylinder provided around said shaft and made of material having a thermal expansion coefficient different from that of said shaft, and a cam groove provided on said cylinder;

a carriage motor which rotatively drives said cam shaft;

a carriage which has a print head mounted thereon and is movably mounted on said cam shaft; and a plurality of prohibiting means respectively provided at boundaries between said shaft and said cylinder of said cam shaft and simultaneously at both ends of a printing area, in order to prohibit distortion of said cam shaft in an axial direction due to a change in temperature.

2. The carriage driver as claimed in claim 1, wherein a thermal expansion coefficient of said shaft is smaller than a thermal expansion coefficient of said cylinder, and wherein said plurality of prohibiting means restrict thermal distortion of said cylinder in said axial direction within an amount of thermal distortion of said shaft in said axial direction.

3. The carriage driver as claimed in claim 2, wherein said plurality of prohibiting means comprise engagements of intrusion with protrusion provided at boundaries between said shaft and said cylinder.

4. The carriage driver as claimed in claim 3, wherein said plurality of prohibiting means comprise:

ring-shaped grooves formed on one of said shaft and said cylinder; and ring-shaped protrusions formed on the other of said one of said cylinder and said shaft for engagement with said ring-shaped grooves.

5. The carriage driver as claimed in claim 4, wherein said shaft comprises metal, and said cylinder engineering plastic, and said shaft and said cylinder are integrally formed by insert injection molding, and wherein, during said insert injection molding, said ring-shaped grooves are formed on said shaft, and said ring-shaped protrusions are formed by intruding said engineering plastic into said ring-shaped grooves provided on said shaft.

6. The carriage driver as claimed in claim 3, wherein said plurality of prohibiting means comprise:

penetrating holes formed through said shaft in a radial direction; and stems formed in said cylinder for engagement with said penetrating holes.

7. The carriage driver as claimed in claim 5, wherein said shaft comprises metal, and said cylinder comprises engineering plastic, and said shaft and said cylinder are integrally formed by insert injection molding, and wherein, during said insert injection molding, said penetrating holes are formed through said shaft in a radial direction, and said stems are formed by intruding said engineering plastic into said penetrating holes.

8. The carriage driver as claimed in claim 1, further comprising at least one second prohibiting means, at one or more positions between ends of said printing area at which said plurality of prohibiting means are provided.

9. The carriage driver as claimed in claim 8, further comprising a third prohibiting means equidistantly positioned from said plurality of prohibiting means provided at ends of said printing area.

* * * * *